United States Patent [19]

Keller, Jr.

[11] Patent Number: 4,484,928

[45] Date of Patent: Nov. 27, 1984

[54] METHODS FOR PROCESSING COAL

[75] Inventor: Douglas V. Keller, Jr., Lafayette, N.Y.

[73] Assignee: Otisca Industries, Inc., Syracuse, N.Y.

[21] Appl. No.: 425,079

[22] PCT Filed: May 27, 1982

[86] PCT No.: PCT/US82/00732

§ 371 Date: May 27, 1982

§ 102(e) Date: May 27, 1982

[87] PCT Pub. No.: WO83/04189

PCT Pub. Date: Dec. 8, 1983

[51] Int. Cl.[3] ..... C10L 9/10; B03D 3/06

[52] U.S. Cl. ..... 44/1 SR; 44/15 R; 209/5; 241/20

[58] Field of Search ..... 44/1 R, 1 SR, 1 G, 24, 44/51; 209/5, 9; 241/20

[56] References Cited

U.S. PATENT DOCUMENTS

| | | | |
|---|---|---|---|
| 4,083,940 | 4/1978 | Das | 44/1 SR |
| 4,186,887 | 2/1980 | Keller, Jr. et al. | 241/20 |
| 4,217,109 | 8/1980 | Siwersson et al. | 44/1 SR |
| 4,244,699 | 1/1981 | Smith et al. | 44/1 SR |
| 4,248,698 | 2/1981 | Keller, Jr. | 209/5 |
| 4,249,699 | 2/1981 | Smith et al. | 241/20 |

*Primary Examiner*—Carl F. Dees

*Attorney, Agent, or Firm*—LeBlanc, Nolan, Shur & Nies

[57] ABSTRACT

Methods of converting raw coals into low ash fuels which are competitive with the heavier grades of petroleum-based fuels and into other products. The raw coal is comminuted in aqueous slurry until resolved into separate, particulate phases of coal and mineral matter. Then, an agglomerating agent is mixed with the slurry until the coal particles have coalesced into agglomerates, and the agglomerates are recovered from the slurry. The ash content of the product coal can be reduced even further by redispersing the product coal in clean water and then reagglomerating the particles of coal and/or by subjecting it to an acid leach.

26 Claims, 3 Drawing Figures

METHODS FOR PROCESSING COAL

TECHNICAL FIELD OF THE INVENTION

The present invention relates to the preparation of fuels and, more particularly, to fuel preparation processes which are unique in that they can be employed to produce coal-type fuels which have an extremely low (<1.0 wt%) ash content and essentially no pyritic sulfur.

DISCLOSURE OF THE INVENTION AND BACKGROUND ART

In general, this novel, and economically important, result is obtained by milling or otherwise comminuting raw coal until it has been reduced in particle size to ca. 250 μm×0 (μm equals micrometer or micron). The raw coal is then slurried in an aqueous liquid, typically clean water; and comminution of the raw coal is continued until the raw coal has been resolved into separate, particulate phases of coal and mineral matter. After this comminution step is completed, a large amount of an agglomerating agent is added to the slurry with agitation; agitation of the slurry is continued until the coal particles have dissociated from the mineral matter and aqueous phases of the slurry and coalesced into agglomerates of product coal; and the agglomerates are recovered from the slurry (there is virtually 100 percent recovery of the carbonaceous material in this separation).

A product coal with an even lower ash content than is available from following the steps identified above can be produced by redispersing the product coal agglomerates in clean water and repeating the agglomeration and collection steps. This sequence can be repeated as many times as wanted although it is presently believed that the benefits obtained by proceeding beyond the third collection step will in general not justify the expense of doing so.

No additional milling is required in the second product coal recovery stage (dispersion, agglomeration, and recovery steps) just discussed or in subsequent repetitions of this sequence of steps. Consequently, the elimination of additional ash afforded by the second (and any subsequent) stages can be effected inexpensively and with only modest expenditures of energy.

Still another technique that can be employed to reduce the ash content of the product coal obtained in the initial (or a subsequent) agglomeration and separation of the product is an acid leach of the product coal.

All of the above-discussed process steps can be carried out at ambient pressure and at ambient temperatures (preferably 70±10° F. (21.2±5.6° C.)).

The process described above can be used to prepare fuels which can compete directly with Bunker C and residual crude oils and synthetic coal fuels which have been successfully employed to fuel gas turbine engines. The flame characteristics of these novel fuels lie between those of flames obtained by burning natural gas and No. 2 fuel oil, respectively.

Specifically, product coals with ash contents of substantially less than 1.0 weight percent have been produced by the foregoing process with demonstrated repeatability from a number of quite different coals. These fuels typically have the following characteristics:

| | |
|---|---|
| Particle Size | down to 4 μm × 0 |
| Ash | down to 0.22 wt % |
| Moisture | below 5 wt % |
| BTU/lb | in the range of 15,000 |
| BTU Percent Yield | approaching 100% |

Small particle size is an important contributing factor to the usefulness of a coal-type fuel. The process described above is eminently capable of generating such fuels as is shown by the foregoing tabulation.

As indicated above, the raw coal being processed into a low ash fuel as disclosed herein is preferably first milled or comminuted while in a "dry" state, formed into an aqueous slurry, and then subjected to further size reduction. Unexpectedly, it has been found that this is economically advantageous while the efficiency of the process is not adversely effected by the dry milling contrary to what is stated in U.S. Pat. No. 4,186,887 which was issued Feb. 5, 1980, to Douglas V. Keller, Jr., et al and which discloses an agglomeration type coal recovery process which, in certain respects, is like the fuel preparation process described herein.

The raw coal is reduced to a top size of ca. 85 percent 250 microns×0 by dry milling, as indicated above, and subsequently ground to an ultimate top size 30 μm with a particle size of 85 percent 15 μm×0 being preferred. In some cases the size distribution of the comminuted raw coal limits the maximum degree of ash reduction. The finer the particles the more mineral matter that can be separated.

Another technique that I can advantageously employ to increase the efficacy of the novel fuel preparation process described above involves the addition of milling aids in small amounts to the raw coal in the second of the comminution steps. Such additives perform one, or both, of two important functions—promotion of particle dispersion, which results in more efficient milling, and protection of freshly exposed particle surfaces against oxidation. This facilitates the subsequent interaction between the coal particles and the agglomerant and thereby promotes more efficient separation of the coal from the mineral matter and liquid phases of the slurry when the separation and agglomeration of the coal particles is carried out.

The particular additives that are employed depend upon the particular coal being cleaned. Additives that have been employed to advantage include: 1,1,2-trichloro-1,2,2-trifluoroethane; OT-100, a dioctyl ester of sulfosuccinic acid marketed by American Cyanamid as an ionic surfactant; Surfynol 104E, a tertiary acetylenic glycol marketed by Air Products and Chemicals, Inc. as a nonionic surfactant; and Triton X-114, an octyl phenol with 7–8 oxide groups marketed by Rhom & Haas Co. as a nonionic surfactant.

Coal particle surface protection is obtained by adsorbing monolayers of the milling additive onto the surfaces of the coal particles in the second (wet) of the milling steps. This requirement can be met by introducing the milling additive into the raw coal slurry at a rate of one-three pounds of additive per ton of coal, depending on the particle size distribution of the raw coal and the molecular area of the additive.

Dispersion of the coal particles in the liquid carrier in the second of the milling steps can also be promoted in many cases by maintaining the pH of the slurry in the range of 6–10 during that step. This can be accomplished by adding a basic material such as sodium hydroxide to the slurry in an amount that increases the pH of the slurry to the desired level.

Reductions in ash content to the levels envisaged herein require an agglomerating agent of particular character; viz., one that has an exceptionally high interfacial tension with water (at least 50 dynes/cm and the higher the better) and a reasonably low viscosity. Agglomeration of the product coal particles in the disclosed fuel preparation process involves attachment of the agglomerant to the particles of coal liberated in the milling steps and the formation of liquid agglomerant bridges between the particles making up each agglomerant. If the interfacial tension between the agglomerant and the aqueous phase of the coal slurry is not at least 50 dynes per cm, microspheres (or bubbles) of water and mineral matter can fill the voids between and around the coal particles making up the agglomerates. This undesirably increases both the moisture and ash content of the product coal. By using an appropriate amount of an agglomerant having an interfacial tension with water of the magnitude identified above, however, the filling of the voids with agglomerant and the ejection of water and mineral matter from those voids into the main body of the slurry can be insured.

Suitable agglomerants for my purposes include such diverse compounds as pentane, 2-methylbutane, 1,1,2-trichloro-1,2,2-trifluoroethane, and trichlorofluoromethane. Essentially pure compounds are required as even small amounts of impurities markedly lower the interfacial tension of the agglomerant with respect to water.

The agglomerant forms stable, monolayer films on the coal particles, rendering the particles more hydrophobic relative to the water phase. The amount of agglomerant needed to achieve a monolayer film can be readily calculated from the area of the coal particles and the area of the specific agglomerant molecules. Similarly, the amount of agglomerant required to achieve separation of up to essentially all of the product coal with low ash contents (typically below one percent) from the mineral water slurry can be calculated using as a first approximation the packing of ideal spheres and the change of the agglomerant film thereon to determine that point where the agglomerant attached to the coal particles just, but completely, fills all of the voids between all of the coal particles, yielding a minimum area for the high energy interfacial contact between the agglomerant and the water in the raw coal slurry.

In the case of 1,1,2-trichloro-1,2,2-trifluoroethane, ca. 0.19 wt % of the agglomerant based on dry coal weight will suffice to form the stable monolayers on the coal particles whereas 45 wt % or more of the agglomerant will have to be dispersed in the diluted raw coal slurry to completely fill the voids between the coal particles making up the product coal agglomerates. Separation over a sieve bend can be readily achieved, and most often the optimum reduction of ash in the product coal (depending on the coal and the size distribution) can be observed, when very near 55 wt % agglomerant has been dispersed on the coal particles. Agglomerant in excess of 65 wt % based on dry coal results in partial or complete separation of one slurry containing liquid agglomerant and product coal from a second slurry of water with mineral matter.

Petroleum fractions such as Varsol, kerosene, and gasoline are occasionally reported as having interfacial tensions with water in the range of 50 dynes/cm. However, these cuts usually contain acids, ketones, and unsaturated and other compounds that effectively lower this value. Consequently, these and comparable cuts such as light hydrocarbon oils heretofore proposed as agglomerants can not be used to reach the goals of the present invention—the generation of a product from raw coal which has minimal ash and pyritic sulfur at recovery rates approaching 100 percent.

One important advantage of the novel agglomerants employed in the practice of the present invention, aside from their high interfacial tensions with water, is that they have a boiling point below that of water. This is particularly important when agglomeration and separation of the product coal is followed by redispersion of the coal particles in clean water, reagglomeration, and separation. Redispersion requires that the concentration of agglomerant with respect to the solids in the agglomerates be reduced in the presence of an aqueous carrier. That cannot be accomplished if the boiling point of the agglomerant is above 100° C. as the carrier will boil off before the agglomerant is evaporated if heat is added to the mixture of agglomerates and water to strip off the agglomerant.

The exemplary agglomerants identified above all have boiling points in the range of 30°-50° C. Agglomerants in that boiling point range are especially desirable as they remain liquid under most ambient conditions but can be dissociated from the product coal and the water-mineral matter phase of the slurry with only modest expenditures of energy. This is important as the cost of the large volume of agglomerant used in a commercial scale operation requires that essentially all of the agglomerant be recovered and recycled.

Another advantage of the preferred class of agglomerants is that they have viscosities of less than one centipoise. This is important because, as a consequence of their low viscosity, those agglomerants can be easily and therefore economically dispersed in the slurry in a manner that will produce the requisite encapsulation of the coal particles by the agglomerant. Specifically, the transport of the liquid agglomerant from the water-solids-agglomerant mixture to the product coal occurs by the impact of dispersed agglomerant on the coal particles and the subsequent wetting of the coal particles by the agglomerant. This process, which tends to homogenize the agglomerant distribution over all of the particles, requires that the viscosity of the agglomerant be below 1000 centipoises; and the process becomes increasingly more efficient as the viscosity decreases below that maximum value.

Another advantage of the agglomerants I employ in addition to their efficacy is that they do not react with coal which is important for the reasons discussed in U.S. Pat. No. 4,173,530 issued Nov. 6, 1979, to Smith et al.

Several advantages of the novel fuel preparation processes described herein have been described above. Another is that they can be employed to produce fuels from raw coals ranging from sub-bituminous through bituminous to anthracite as well as from lignite which has above and will hereinafter also be included in the term "coal" for the sake of convenience.

High ranked, unoxidized coals have a natural hydrophobicity and can be treated by the agglomeration type separation process as described above.

Partially oxidized coals and coals of lower rank, however, lack this natural hydrophobicity to at least some extent because of their oxygen content. Hydrophobicity to the desired extent can be induced in such coals by using a surfactant to modify the naturally hydrophilic surfaces of the coal and, in effect, transform it into a hydrophobic coal that responds to the process in the same manner as one that is naturally hydrophobic.

The surface active agent, which may be oleic acid or one of its soluble salts, is preferably mixed with the slurry prior to the separation and agglomeration of the product coal particles in an amount sufficient to produce a monolayer of surfactant on the coal. The carboxylic acid (or comparable) group of the surface active agent attaches to the polar surface of the coal, allowing the molecule to establish an apparent coal surface which is repulsive to water because of induced hydrophobicity but possesses a strong attraction to the agglomerant. This allows the lower rank or partially oxidized coal particles to be dissociated from the mineral matter and aqueous phases of the slurry and then agglomerated in the same manner as unoxidized coals of higher rank.

Excess surfactant must be avoided, however, as the excess will significantly reduce the interfacial energy between the agglomerant and the water in the slurry, causing an increase in the ash content of the product coal agglomerates. To avoid this same undesirable result, care must be exercised to avoid the use of surfactants that would render the surfaces of the mineral matter particles in the slurry hydrophobic.

Strong Lewis bases can also be employed to induce hydrophobicity in partially oxidized and lower ranked coals. Lewis bases can be combined into a single molecule with a hydrophobic, organic chain or ring. The Lewis base moiety of the molecule attaches the latter to the coal particles, and the organic fractions of the compounds form a monolayer of additive that renders the entire surface of each coal particle hydrophobic. Those surfaces accept the agglomerating agent in a manner identical to that characteristic of an unoxidized, high ranked coal.

Lewis base-containing molecules that can be employed for the purposes just described are those of the formulas R-OH, $R_2$-$NH_3$, R-$NH_2$, and $R_3N$ where R is an organic chain or ring with more than four hydrocarbons.

An alternative to inducing hydrophobicity is to increase the agglomeration time for partially oxidized and/or lower rank coals. Unoxidized, high rank coals can be completely agglomerated in periods of $<$5–15 seconds. By increasing the time to minutes, many oxidized coals can also be successfully agglomerated although others cannot because agglomeration time increases with the state of oxidation, reaching infinity for a fully oxidized coal.

It was pointed out above that U.S. Pat. No. 4,186,887 discloses a process having some similarities to the novel fuel preparation processes disclosed herein. There are also significant differences.

For example, the fuel preparation processes described herein differ from the coal recovery process described in U.S. Pat. No. 4,186,887 in that there is no milling during the coal recovery phase of the process in which the coal particles are dissociated from the mineral matter and aqueous phases of the slurry in which they are found and then coalesced into product coal agglomerates. This is significant because it has been found that wear—for example, of the balls in a ball mill—by prolonged milling continued into the recovery phase can result in enough worn away material being agglomerated with the coal to significantly increase the ash content of the latter.

The novel fuel preparation processes disclosed herein also differ significantly from the coal beneficiation process described in U.S. Pat. No. 4,186,887 in that the addition of the agglomerant to the coal slurry and the subsequent dissociation of the coal particles from the mineral matter and aqueous phases of the slurry and coalesence of those particles into agglomerates are preferably carried out separately.

As discussed above, the essentially complete separation of the coal particles from the associated mineral matter achieved by the fuel preparation processes described herein requires that a monolayer of the agglomerant be adsorbed on the surface of each coal particle. This can most efficiently be achieved in a different unit than the subsequent separation of the product coal from the slurry because the dispersion of the agglomerant is a kinetic process requiring a finite period of time. By carrying out this step separately, one can insure that the wanted dispersion of the agglomerant is completed before the separation of the product coal from the agglomerant is attempted.

OBJECTS OF THE INVENTION

From the foregoing, it will be apparent to the reader that one primary object of the present invention resides in the provision of novel, improved coal-type fuels and in the provision of novel processes for producing those fuels.

Another primary and therefore important object of the present invention resides in the provision of coal-type fuels which are competitive with the heavier grades of petroleum-based fuels.

An additional primary object of the present invention resides in the provision of coal-type fuels which can be employed to fuel gas turbine engines.

Still other important, but more specific, objects of the invention reside in the provision of coal-type fuels which:

- have an extremely low ash content;
- have a high BTU content;
- have a particle size distribution that permits them to be burned efficiently;
- are well within the specifications established by major consumers of such fuels.

Yet other specific but nevertheless important objects of the present invention residue in the provision of novel processes for producing fuels from raw coal which:

- are capable of producing coal as characterized in the preceding objects;
- are capable of making such coals available at competitive costs on commercial scales;
- can be carried out in equipment that is relatively uncomplicated, that only needs low maintenance, that is simple to operate, and that can be made available with only a modest capital investment;
- can be employed to produce fuels from virtually any coal ranging from lignite through sub-bituminous to anthracite;
- are non-polluting and energy efficient;
- can be carried out at ambient temperature and pressure;
- are capable of recovering up to on the order of or exceeding 95 percent of the coal from the raw coal that is processed.

Still other important objects of the invention reside in the provision of processes with the attributes described above that can be used to produce product coals for uses other than as fuels and in the provision of such product coals with the desirable attributes identified above.

Additional, important objects and advantages of the invention and other novel features thereof will be apparent to the reader from the foregoing; from the appended claims; and as the ensuing detailed description and discussion of the invention proceeds in conjunction with the accompanying drawing.

PREFERRED EMBODIMENTS OF THE INVENTION

Figure 1:
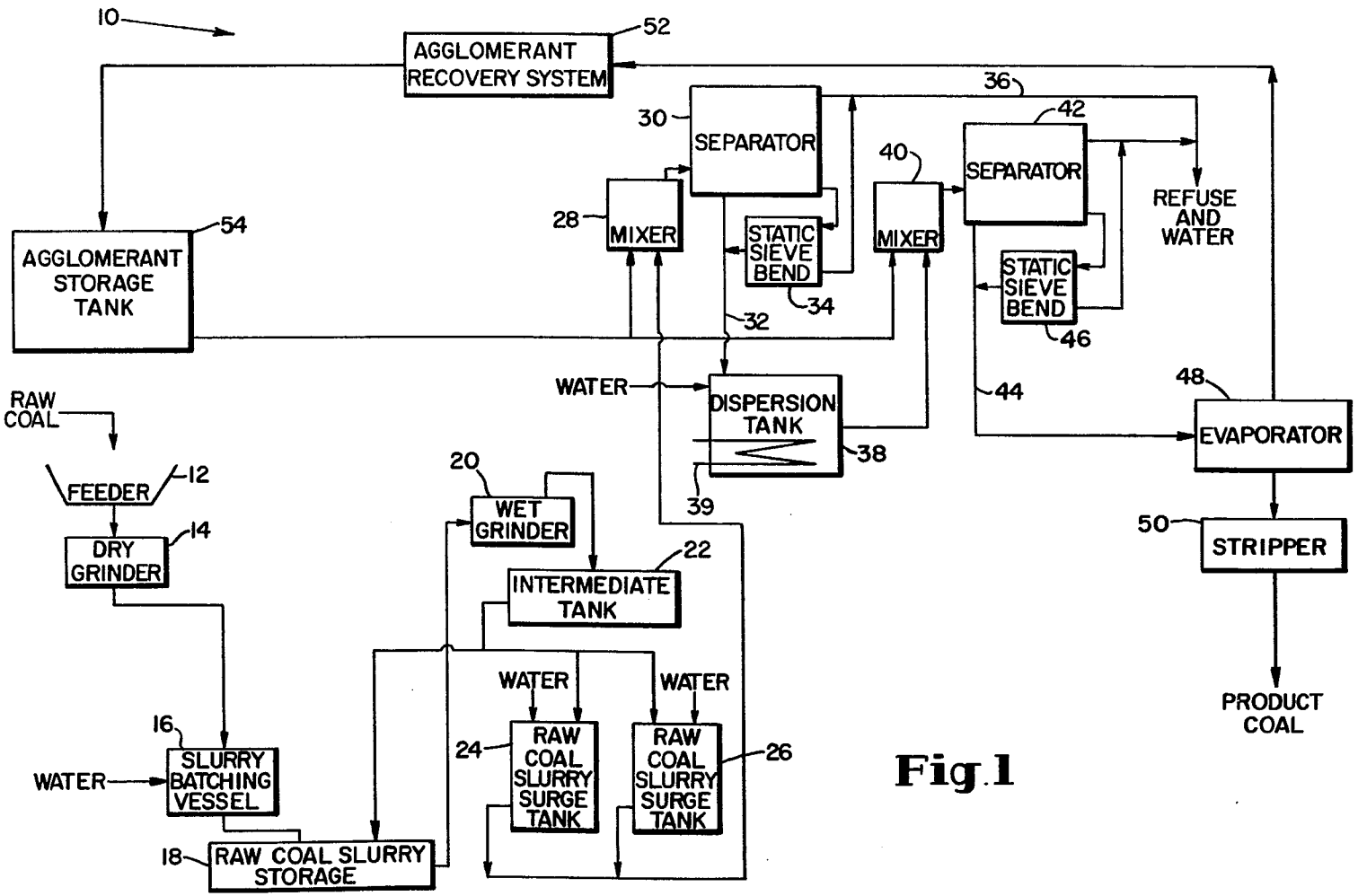
FIG. 1 is a schematic diagram of a plant in which the preparation of a low ash product coal can be carried out in accord with the principles of the present invention.

Referring now to the drawing, FIG. 1 schematically depicts a plant 10 in which raw coal can be converted to a low ash coal having the characteristics discussed above in accord with the principles of the present invention. As is apparent from the drawing, plant 10 is relatively uncomplicated. This makes it easy to operate, inexpensive and simple to maintain, and available with a relatively low capital investment.

In terms of process steps, the first major component of plant 10 is a feeder 12 which transfers the raw coal being processed to a dry grinder 14 which may be, for example, an impact mill, ball mill, race mill or the like. Dry grinder 14 is employed to reduce the raw coal to a size consist typically about 85 percent 250 microns×0.

From dry grinder 14, the pulverized raw coal is transferred to a slurry batching vessel 16. Here, the raw coal is mixed with clean water to form an aqueous slurry having a solids content in the range of 20 to 70 wt %. The particular weight percent that is employed depends on the coal and is adjusted to optimize the efficiency of the milling process.

The raw coal slurry is transferred to a slurry storage tank 18 from batching vessel 16. This tank provides a capacitance in the system; i.e., it permits plant 10 to be operated continuously notwithstanding the fact that several steps in the process are carried out in batch fashion as will become apparent hereinafter.

From raw coal slurry storage tank 18, the slurry is transferred to a wet grinder 20 where the raw coal is reduced to a particle size distribution preferably on the order of 95% 30–15 microns×0 although the smaller top size is preferred because, as discussed above, this results in a fuel which can be more efficiently burned.

The wet grinder may be, for example, a ball mill, stirred ball mill, vibratory mill, roll mill, etc.

I consider it necessary that a minimum of 20 wt % water based on the weight of the slurry be maintained in mill or wet grinder 20. Lower amounts do not provide a sufficiently large body of liquid to hold the mineral matter in suspension, which is a requisite to efficient and uniform grinding. The maximum concentration of aqueous liquid permitted in wet grinder 20 is that at which comminution of the raw coal becomes inefficient (typically ca. 70 wt %).

The milling step just described liberates the mineral matter from coal to which it is bound. It also generates on the coal particles fresh surfaces to which the agglomerant can readily adhere.

It was pointed out above that milling aids can often be employed to advantage in wet grinder 20 to promote the dispersion of the raw coal particles in the aqueous carrier and to protect the surfaces of the product coal particles liberated in the milling process. Milling additives, or mixtures of appropriate additives, can be added to, and mixed with, the slurry in either the raw coal slurry storage tank 18 or in the wet grinder itself.

The wet grinding step is continued until the desired particle size distribution of the raw coal has been obtained. If a ball mill is employed, this may take up to sixteen hours or more. The time required for the wet grinding step can be reduced to a matter of minutes by using other types of milling processes such as the stirred ball mill discussed above. However, this is done only at the expense of increases in capital cost and energy requirements.

From wet grinder 20, the raw coal slurry is transferred to an intermediate tank 22. This tank 22 is provided so that quality control checks can be performed before the recovery of the product coal from the mineral matter and aqueous phases of the slurry is effected. Parameters that are measured are particle size distribution and pH which, as indicated above, is preferably maintained in the range of 6–10.

Out-of-specification material is returned to slurry storage tank 18 for reprocessing through wet grinder 20. If the slurry is within specifications, it is transferred to one of two raw coal slurry surge tanks 24 and 26.

Water is added to the slurry transferred to the surge tanks to dilute the slurry to a solids concentration of about 1 to 15 weight percent. This promotes the subsequent separation of product coal particles from the associated mineral matter in the slurry and the aqueous carrier. It has been observed that, as the concentration of solids is reduced during agglomeration, the efficiency of ash reduction is increased.

Also, like storage tank 18, surge tanks 24 and 26 provide capacitance in the fuel preparation system. This provides independence of operation between the milling circuit just discussed and the next-to-be discussed circuit in which the product coal particles are separated, agglomerated, and recovered from the slurry. This circuit isolation is desirable because, in the event of malfunction of any of the interconnecting components, the subsequent stages can operate for a substantial period of time without interruption of subsequent unit processes.

Referring again to the drawing, the more dilute, raw coal slurry is transferred alternately from surge tank 24 and surge tank 26 to mixer 28 where the selected agglomerant is added to and mixed with the slurry in a ratio of 45 to 60 wt % based on the dry weight of the coal in the slurry.

The just specified minimum amount of agglomerant is that which I have found necessary to effect efficient agglomeration of the coal particles liberated in the milling steps. Concentrations above the stated maximum are undesirable for the reasons discussed above and because the excess additive forms a film through which substantial numbers of the mineral matter particles may not have sufficient energy to escape, resulting in their being trapped in the coal agglomerates and raising the ash content of the product.

High shear mixers have been employed to distribute the agglomerant but are not required as long as the mixer will homogenously disperse the agglomerant within the raw coal slurry in a manner insuring that monolayers of the agglomerant are formed on the surfaces of the product coal particles. High shear mixers do have the advantage that the dispersion of the agglomerant can be effected in a very short period of time.

Mechanically, the formation of the agglomerant monolayers on the product coal particles takes place through particle-particle impact until a liquid film has been formed on each particle. Probably, these films are of equivalent thicknesses on all of the particles when equilibrium is reached. This will typically require about one minute when a high shear mixer is employed to disperse the agglomerant.

From mixer 28, the slurry is transferred to separator 30 which may be a rotating drum or spheroidizer. Here, the dissociation of the product coal from the mineral matter and aqueous phases of the slurry and the formation of product coal agglomerates initiated in mixer 28 are continued and the agglomerates dimensionally stabilized; and water is expelled from the agglomerates, contributing to the quality of the product. Thus, separator 30 serves as a polishing unit for mixer 28. The residence time of the slurry in separator 30 will typically be only a few minutes.

Thus, the just-discussed carrying out of the agglomerant dispersion and product coal agglomeration steps in two different process units is an important feature of the present invention because it permits the conditions in each of these two units to be optimized for the steps carried out therein.

A fraction of the product coal agglomerates are recovered and discharged directly from separator 30 as indicated by line 32 in the drawing. The remainder of the agglomerates and the aqueous and dispersed mineral phases of the slurry are discharged to a static sieve bend 34. Here, the remainder of the product coal agglomerates are recovered while the water and mineral matter are discharged into a refuse circuit shown schematically in the drawing and identified by reference character 36.

The product coal recovered from separator 30 and sieve bend 34 may have an ash content of less than one percent and a moisture content of ca. 20 percent.

Coal with the specifications described in the preceding paragraph is a directly usable, superior fuel. However, the ash content of the fuel can be reduced even further and its usefulness increased by applying the principles of the present invention. To accomplish further ash reduction, the agglomerates recovered from separator 30 and sieve bend 34 are transferred to a dispersion tank 38 equipped with a heater 39 where they are mixed with sufficient clean water to reduce the concentration of solids to on the order of not more than about 30 to 10 wt %.

At the same time, the concentration of the agglomerant is lowered to 20–30 wt % based on the weight of the solids in the slurry, typically by evaporating part of the agglomerant from the slurry. Heater 39 may be employed to supply any thermal energy necessary for this purpose that is not available from the ambient surroundings.

Upon being reduced to the level or concentration just identified, the agglomerant becomes capable of bonding together the particles of product coal making up the agglomerates. Those particles consequently dissociate and disperse in the aqueous carrier, freeing and dispersing in the aqueous carrier of the slurry any particles of mineral matter that may have been entrapped in the agglomerates in the initial coal recovery and agglomeration step.

From tank 38, the aqueous slurry of redispersed coal particle and liberated mineral particles is transferred to a mixer 40 which may be of the same character as the mixer 28 discussed previously. Here, sufficient agglomerant is mixed with the slurry to again increase its concentration to the 45 to 60 wt % of agglomerant based on dry coal weight required for efficient agglomeration and recovery of the product coal.

The aqueous slurry of redispersed coal particles, freed mineral particles, and agglomerant is next transferred to a separator 42 which may duplicate separator 30. After agglomeration and stabilization of the agglomerates is completed, a fraction of the coal particle agglomerates are separated and discharged directly from the separator as indicated by line 44. The remainder of the agglomerates, together with the additional mineral matter dissociated from the coal in separator 42 and the aqueous carrier, are passed over a static bend sieve 46, the coal being discharged to line 44 and the water and mineral matter to refuse circuit 36.

At this stage, the product is eminently suitable as a fuel as it will typically have a heat content approaching 15,000 BTU/lb while the ash content of the product will typically have been reduced another two-thirds from 3 to 1 percent to 1 to 0.3 wt % based on the dry weight of the product. The moisture content of the product coal can be controlled from 10 to 40 wt % by way of the process parameters. Additional moisture can be removed by passing the agglomerates through wringer rolls (not shown) although this will typically not be necessary.

The combined fractions of product coal agglomerates from separator 30 and separator 42 are processed seriatim through an evaporator 48 and a stripper 50. The agglomerant is recovered from the agglomerated coal particles in these units; circulated to an agglomerant recovery system 52 where it is freed of non-condensible gases and condensed; and then returned to agglomerant storage tank 54, all as described in above-cited U.S. Pat. No. 4,173,530 which is hereby incorporated herein by reference. The mixture of water and dispersed mineral matter in circuit 36 may be transferred to an agglomerant scrubber (not shown) which reduces the agglomerant content of the refuse from about 100 ppm to less than 10 ppm. Thereafter, the agglomerant is combined with that recovered from the product and elsewhere in system 10.

The slurry passes to a conventional thickener (also not shown) where the water is clarified and recycled. The now semisolid refuse is transferred to a landfill, for example.

The examples which follow describe tests illustrating various novel facets of my novel fuel preparation processes.

EXAMPLE I

As suggested above, perhaps the most important advantage of the novel fuel preparation process described herein is the extremely low ash content that can be obtained. This was demonstrated by the following head-to-head test between the foregoing process and the coal beneficiation process disclosed in U.S. Pat. No. 4,186,887.

A sample of raw coal from the Pittsburg seam (Bethlehem Marianna Mine No. 58) was separated into two fractions. One was treated as specified in Example I of U.S. Pat. No. 4,186,887 and the other by the following procedure.

The raw coal was dry milled to 250 μm×0 in a hammer mill and mixed with tap water to a 30 wt % solids concentration. The pH of the resulting slurry was adjusted to 8 by adding sodium hydroxide, and the slurry was then ground in a laboratory ball mill for 16 hours. The resulting slurry was removed from the ball mill and diluted to 10 wt % solids. The diluted slurry was placed in a Waring Blender and 50 wt% (based on dry coal) of 1,1,2-trichloro-1,2,2-trifluoroethane was added with the blender running to separate and agglomerate the coal particles. Upon agglomeration (30–60 sec) the contents of the blender were removed and passed over a sieve bend which retained the coal agglomerates and allowed the mineral matter-water slurry to pass.

The particles making up the product coal agglomerates were redispersed by adding sufficient water to produce an aqueous slurry with a solids content of ca. 10 wt % and allowing agglomerant to evaporate until the agglomerates could be seen to have dissociated. Agglomeration of the redispersed particles and separation of the agglomerates that formed were effected using the procedure described above; and the sequence of redispersion, agglomeration, and separation of the agglomerates was repeated.

The agglomerates obtained in the third separation step were dried and analyzed. The following data was obtained:

TABLE I

| | Raw Coal Analysis | Product, U.S. Pat. No. 4,186,887 Technique | Product, Present Technique |
|---|---|---|---|
| Ash, Wt % | 5.71 | 2.38 | 0.89 |
| #/MM BTU | 3.99 | 1.60 | 0.59 |
| % Reduction | — | 59.9 | 85.2 |
| Total Sulfur, Wt % | 1.24 | 0.90 | 0.82 |
| #/MM BTU | 0.87 | 0.61 | 0.54 |
| % Reduction | — | 29.9 | 37.9 |
| BTU/lb | 14,301 | 14,842* | 15,093* |
| BTU/lb (MAF)** | 15,167 | 15,204 | 15,229 |
| BTU Yield, % | | >95 | >95 |

(1) All Data: Dry Basis
(2) *Calculated
(3) Both Runs Starting at 60 mesh × 0
(4) **Moisture and Ash Free The product coal generated by using the patented process had an ash content of 2.38 percent with a near 100% product yield. This ash content is much lower than can be obtained by any other coal beneficiation processes on which information has been obtained. However, the product which was obtained from the same raw coal by employing the process disclosed herein had a still, and substantially, lower ash content of only 0.89 percent; and subsequent tests on the same coal have resulted in ash contents in the range of 0.64 wt %. This is of signal significance as the reduction of the ash content of the coal to this uniquely low level makes the coal competitive in terms of ash-loading with the presently widely used, heavier grades of petroleum-based fuels.

At the same time, these coal-based fuels have a definite cost advantage over the petroleum-based products. For example, Pittsburg seam coal was recently available in the market at a cost in the range of $1.00/10^6 BTU. The calculated cost of converting that coal to the directly usable fuel identified above with the procedure described in this example is $1.60 per $10^6$ BTU, and the cost of shipping that coal could be in the range of $0.50 per $10^6$ BTU, making the total cost of the fuel at the point of delivery $3.10 per $10^6$ BTU. The then comparable delivered cost of Bunker C fuel was calculated at a significantly higher $28.00 per barrel or $5.00 per $10^6$ BTU.

EXAMPLE II

It was pointed out above that the ash content of a product coal obtained by the processes disclosed herein can be further, and significantly, reduced by leaching the ash from the coal with an appropriate acid. This was demonstrated by tests in which Blue Gem and Pittsburgh seam product coals obtained by following the procedure described in Example I were further processed with a nitric acid leach. The tests involved a Blue Gem seam product coal with an ash content of 0.4 wt % and Pittsburgh seam product coals with ash contents of 1.1 and 0.9 wt %.

The acid leach was carried out by refluxing dry samples of coal in 4 normal nitric acid for 30 minutes, recovering the residue, and drying and ashing it according to ASTM procedure D3174-73.

Results of the tests are tabulated below.

TABLE 2

| | Ash Content | |
|---|---|---|
| Seam | Product Coal | Acid Leached Product Coal |
| Blue Gem | 0.4 | 0.08 |
| Pittsburg | 1.1 | 0.43 |
| Pittsburg | 0.9 | 0.38 |

EXAMPLE III

To demonstrate the effect of milling time (wet) on the ash content of fuel prepared in accord with the principles of the present invention, coal from the Blue Gem seam having a particle size distribution of 63 μm×0 was placed in a laboratory ball mill for various periods of time to effect different particle size reductions and to produce different average particle sizes (defined as 50 wt % of the particles finer than the average particle diameter). That raw coal was milled in water at a concentration of 30 wt % solids.

After milling, the 30 wt % solids slurry was diluted to 10 wt % and placed in a Waring Blender. About 50 wt % of 1,1,2-trichloro-1,2,2-trifluoroethane (based on dry raw coal weight) was added and mixed with the slurry until agglomerates of coal particles were formed (about 15–45 seconds). The agglomerates were separated on a sieve bend, the coal collecting on the surface of the sieve bend and the water (plus mineral matter) passing through the sieve bend.

The results are shown in Table 3 below.

TABLE 3

| Size Distribution | Product Average Particle Diameter (Microns) | Ash (Wt %) |
|---|---|---|
| Raw coal, 63 μm × 0 | 20 | 0.97 |
| 4 hours milling, 32 μm × 0 | 5.7 | 0.58 |

TABLE 3-continued

| Size Distribution | Product Average Particle Diameter (Microns) | Ash (Wt %) |
|---|---|---|
| 8 hours milling, 23 μm × 0 | 3.5 | 0.52 |
| 16 hours milling, 11 μm × 0 | 2.5 | 0.49 |

EXAMPLE IV

Another above-discussed, demonstrably effective technique that can be employed in the fuel preparation processes disclosed herein involves the use of a basic material in the second (wet) of the milling steps to adjust the pH of the slurry being treated in that step to, and to maintain it at, a pH in the range of 6–10. This was shown by a test which was conducted with the same coal and procedure as discussed in Example I except that the pH was adjusted as indicated in Table 4 below in which the data obtained from the test are tabulated.

TABLE 4

| pH of Slurry | Product Coal, Wt % Ash | | |
|---|---|---|---|
| | 1st Collection | 2nd Collection | 3rd Collection |
| Acidic pH <3 | 1.78 | 1.29 | 1.17 |
| Basic pH >8 | 1.19 | 0.72 | 0.68 |
| Neutral pH ≅7 | 1.32 | 1.04 | 0.95 |

EXAMPLE V

That the amount of milling, and, consequentially, the degree of particle size reduction, has marked effect on the ash content of the product coal generated by the techniques disclosed herein was also demonstrated by tests employing commercially beneficiated 1.5 inch×0 coal from the Illinois No. 6 (Herrin) seam located at the Old Ben Coal Company No. 21 Mine, Franklin County, Ill.

In accord with the present invention, that raw coal was dry ground to a size consist of 250 microns×0 and formed into a 30 wt % slurry with water. The coal was then milled and agglomerated as described in Example III, and the product coal agglomerates were recovered and analyzed.

The results are tabulated in Table 5 below.

TABLE 5

| Milling Regime | Illinois No. 6 Seam | |
|---|---|---|
| | Product Coal Ash (Wt %) Sample A | Product Coal Ash (Wt %) Sample B |
| Raw Coal (250 μm × 0) | 6.36 | 6.82 |
| 2 hours milling | 3.04 | 3.07 |
| 4 hours milling | 1.75 | 2.36 |
| 8 hours milling | 1.13 | 1.22 |
| 16 hours milling | 1.23 | 1.19 |

EXAMPLE VI

As discussed above, the use of an agglomerant which has a high interfacial tension with water is essential to the success of the process described herein. This was demonstrated by repeating the procedure described in Example I using two different coals and a variety of agglomerating agents or agglomerates. The results appear in Tables 6 and 7 below.

TABLE 6

| Peerless Coal (Raw Coal: 37 μm × 0, 14.88 Wt % Ash) | | |
|---|---|---|
| Agglomerant | Interfacial Tension With Water (dynes/cm) | Product Coal Wt % Ash |
| No. 6 Fuel Oil | 32 | 6.5 |
| Benzene | 35 | 4.5 |
| Gasoline | 45 | 2.6 |
| Carbon Tetrachloride | 45 | 2.8 |
| Kerosene | 50 | 2.6 |
| Mineral Oil | 50+ | 2.8 |
| Pentane | 51.3 | 2.8 |
| Trichlorofluoromethane | 52.8 | 2.5 |
| 1,1,2-Trichloro-1,2,2-trifluoroethane | 51.1 | 2.0 |
| 2-Methyl butane | 50.1 | 2.0 |

TABLE 7

| Ulan Coal (Australia; Raw Coal Ash 10.55 Wt %) | | | | |
|---|---|---|---|---|
| Agglomerant | Interfacial Tension With Water | Wt % Ash, Product Coal | | |
| | | 1st Collection | 2nd Collection | 3rd Collection |
| No. 6 Fuel Oil | 32 dyne/cm | 6.53* | | |
| Benzene | 35 | 4.55 | 2.40 | 1.82 |
| Gasoline | 45 | 2.85* | | |
| Carbon Tetrachloride | 45 | 2.88 | | |
| Kerosene | 50 | 2.44 | | |
| Mineral Oil | 50+ | 2.40* | | |
| Pentane | 51.3 | 2.51 | | |
| 2 Methyl Butane | 50.1 | 2.01 | | |
| 1,1,2-Trichloro-1,2,2-trifluoroethane | 51.1 | 2.04 | 1.08 | 0.84 |

*Subsequent collections proved impossible as there is no way to effect further coal dispersal after one collection.

The foregoing data confirm that the use of an agglomerant having a high interfacial tension with water is important in processing coal by the procedures described herein. The data also show that this requirement exists independently of the particular coal being treated.

Figure 2:
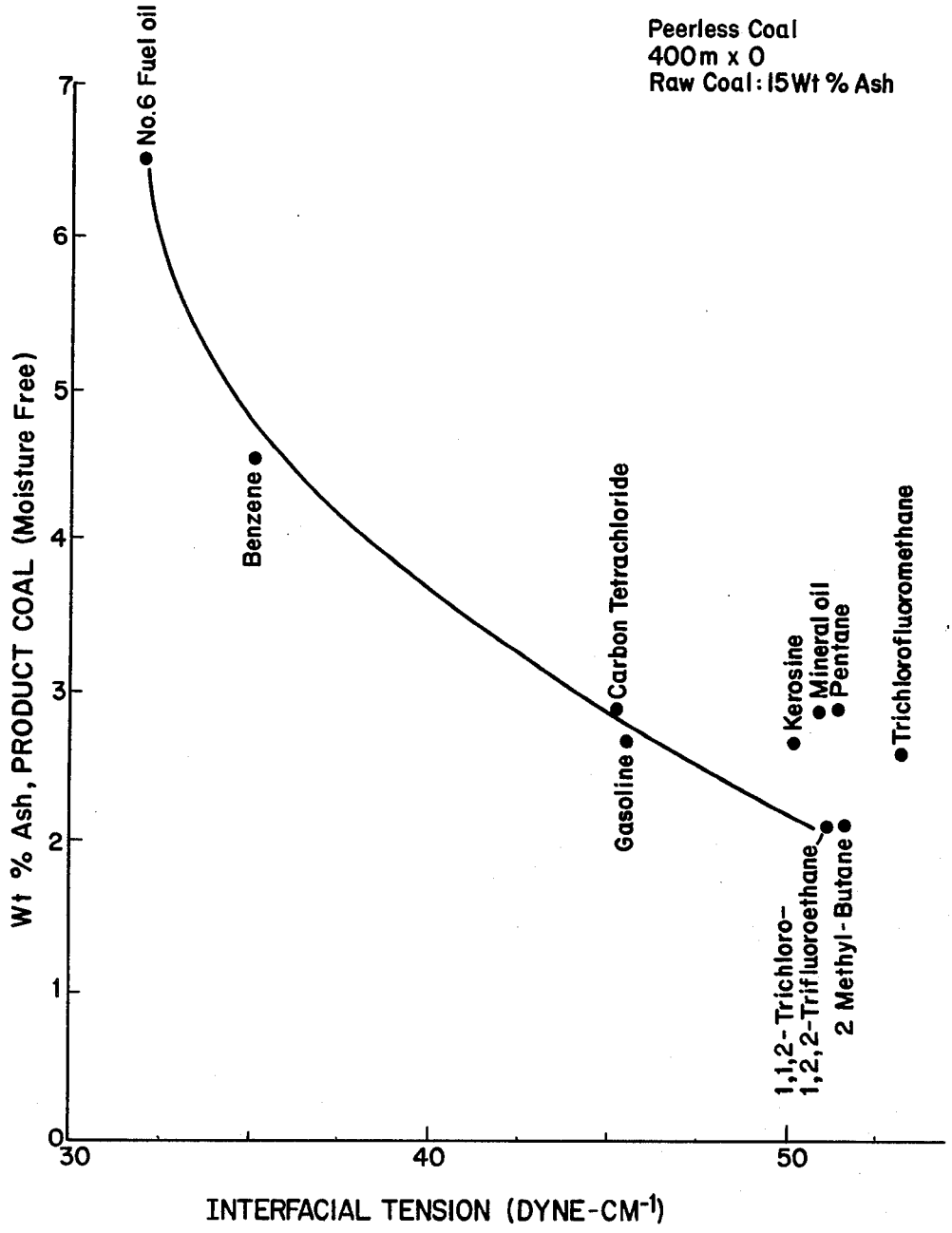
FIG. 2 is a graph showing the effect of the interfacial tension between the agglomerant and water on the ash content of a low ash coal prepared in accord with the principles of the present invention.
Figure 3:
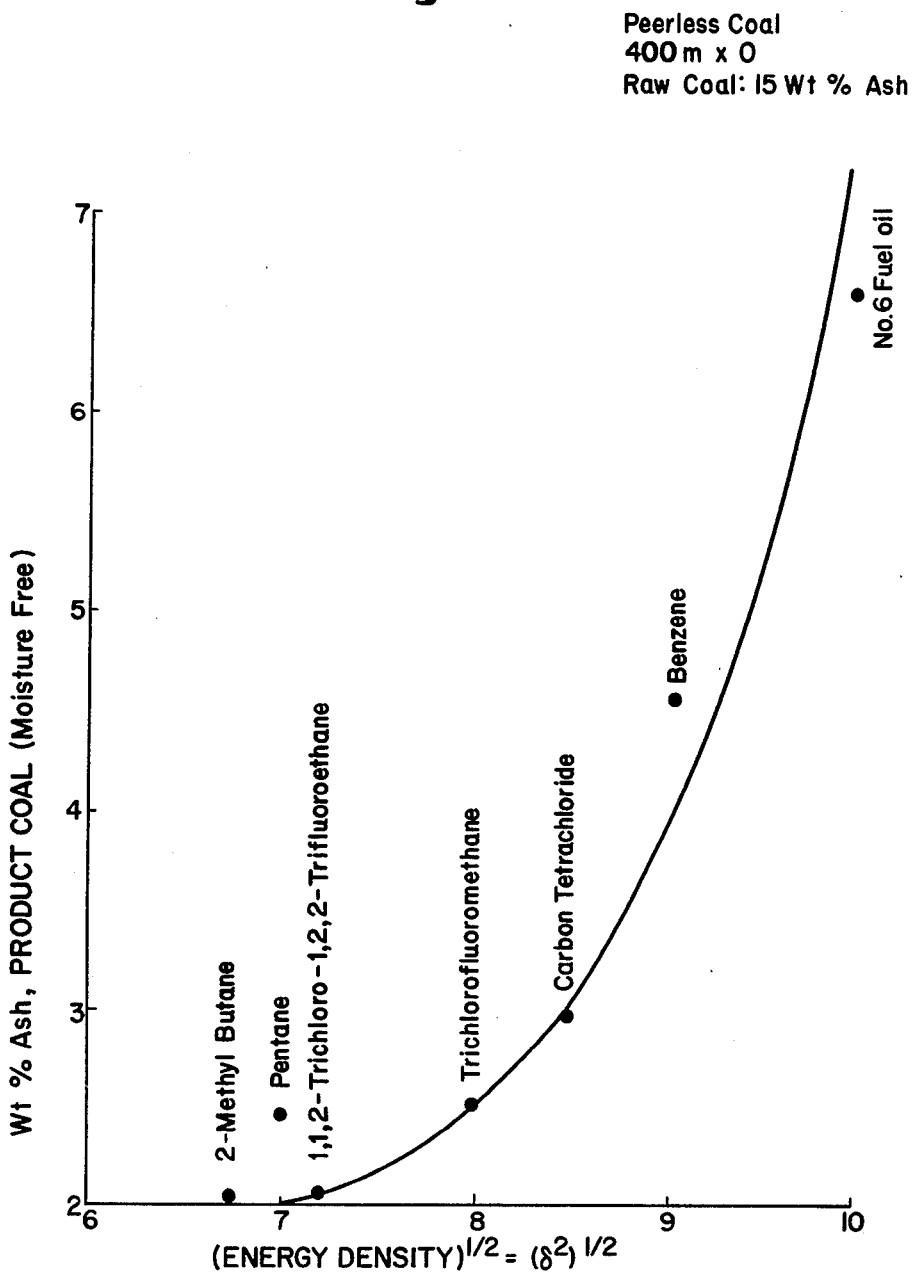
FIG. 3 is a graph showing the effect of the energy density of the agglomerant upon the ash content of a low ash coal prepared in accord with those principles.

That a high agglomerant-water interfacial tension is a requisite to the generation of a low ash coal by agglomeration type separation is also demonstrated by the data tabulated graphically in FIG. 2, in which the ash content of a product coal generated from a Peerless seam sample is plotted against interfacial tension. The raw coal was processed essentially as described in Example I.

EXAMPLE VII

The concentration of the agglomerant employed in the practice of the invention disclosed herein can be varied considerably as long as the amount used meets the criteria specified above. This was confirmed by repeating the procedure described in Example I substituting various weight percents of 1,1,2-trichloro-1,2,2-trifluoroethane based on the weight of the raw coal for that used in the test described in the earlier example. The results are tabulated below and compared with those reported in Example I.

TABLE 8

| Wt % of Agglomerant Based on Dry Coal Weight | Product Coal Wt % Ash, Second Agglomeration Step |
|---|---|
| 40 | 1.07 |
| 50 (Example I) | 0.93 |
| 60 | 1.16 |
| 70 | 1.18 |
| 80 | 2.31 |

EXAMPLE VIII

To demonstrate the advantages of redispersion and reagglomeration, a Pittsburgh seam coal with an ash content of 4 wt % and a Blue Gem seam coal with an ash content of 3 wt % were processed as described in Example I (three agglomerations, initial and two following redispersion of collected agglomerates).

Samples of the product coal were taken from each agglomeration before the next subsequent agglomeration step (a fourth collection did not significantly alter the ash in the product coal).

The results of the tests are set forth in Table 9.

TABLE 9

| Run | Coal | Additive[3] | Mill Time (hours) | Product Coal Wt % Ash: First Collection | Second Collection | Third Collection |
|---|---|---|---|---|---|---|
| 1 | PGH[1] | None | 8 | 1.70 | 1.16 | 1.05 |
| 2 | PGH | A | 8 | — | 0.95 | — |
| 3 | PGH | B | 8 | 1.44 | 0.84 | 0.88 |
| 4 | PGH | C | 8 | 1.41 | 0.93 | 0.85 |
| 5 | PGH | D | 8 | 1.11 | 0.64 | 0.59 |
| 6 | PGH | E | 23 | 1.10 | 0.66 | 0.52 |
| 7 | PGH | F | 23 | 1.26 | 0.60 | 0.59 |
| 8 | PGH | G | 8 | 1.34 | 0.86 | 0.73 |
| 9 | PGH | H | 8 | 1.26 | 0.82 | 0.72 |
| 10 | PGH | I | 16 | — | — | 0.83 |
| 11 | BG[2] | None | 4 | 0.69 | — | 0.55 |
| 12 | BG | None | 16 | 0.64 | — | 0.40 |

[1]PGH = Pittsburgh Seam
[2]BG = Blue Gem Seam
[3]Identified in Table 10

TABLE 10

| Code | Additive | Concentration (Wt % Based on Weight of Raw Coal) |
|---|---|---|
| A | NaOH | pH adjusted to 8 |
| B | NaCN—NaOH | 1.4 lbs/ton, pH adjusted to 10 |
| C | NaCN—$Na_2CO_3$ | 1.4 lbs/ton, pH adjusted to 10 |
| D | Citric Acid-NaOH | 0.7 lbs/ton, pH adjusted to 10 |
| E | Citric Acid | 1.4 lbs/ton |
| F | Citric Acid-NaOH | 1.0 lbs/ton, pH adjusted to 10 |
| G | Citric Acid-NaOH | 1.4 lbs/ton, pH adjusted to 10 |
| H | Citric Acid-Sodium Dithionate | 2 lbs/ton |
| I | Methanol | 3 lbs/ton |

The data in Table 9, above are significant for several different reasons.

First, they show that substantial, additional amounts of ash can be separated by dispersing product coal agglomerates and repeating the agglomeration step and, also, by repeating the dispersion and agglomeration sequence of steps.

Also, the data confirm that milling additives can have a marked effect on the ash content of the product coal. This, additionally, underscores the importance of carefully matching the additive to the specific coal being processed into fuel by the procedures disclosed herein.

Furthermore, the data clearly demonstrate that the fuel preparation process in question is eminently capable of producing fuels which have sufficiently low ash contents (ca. 0.5 wt % or less) to make them competitive with petroleum-based fuels.

EXAMPLE IX

To demonstrate the wide ranging utility of the novel fuel preparation processes described herein, the procedure described in EXAMPLE I was repeated using as feedstocks bituminous coals with considerable different morphologies and compositions than the Pittsburg seam Coals employed in the EXAMPLE I tests and an anthracite coal. The variations in the EXAMPLE I procedure utilized to optimize the procedure for the different feedstocks are identified and the results of the tests tabulated below.

TABLE 11

| Coal | Procedural Modifications | Wt % Ash |
|---|---|---|
| Anthracite (Tamaqua, PA) | Raw Coal | 7.98 |
| | Mill @ pH < 3; Product Coal | 0.76 |
| Bituminous (Ulan, Australia) | Raw Coal | 10.55 |
| | Product Coal | 0.84 |
| Bituminous (Peerless Seam) | Raw Coal | 14.88 |
| | Product Coal | 0.95 |
| Bituminous (New Zealand) | Raw Coal | 1.00 |
| | Product Coal | 0.22 |

EXAMPLE X

It was pointed out above that compounds in which a Lewis base is combined with an organic chain or ring can advantageously be employed to impart hydrophobicity to the surfaces of partially oxidized or lower ranked coals, thereby increasing the number of sites available to the agglomerant to the level possessed by an unoxidized, higher rank coal and that, as a consequence, the agglomeration type coal separation processes described herein can proceed as efficaciously in the former cases as it does in the latter. This novel aspect of the present invention was demonstrated in tests which were conducted as described in EXAMPLE I with the modifications identified in TABLE 12 below in which the results of the tests are also presented.

TABLE 12

| Coal | Ash, Raw Coal (Wt %) | Lewis Base Additive (2 lbs/ton of Coal) | Agglomeration Time | Ash, Product Coal (Wt %) |
|---|---|---|---|---|
| Ulan (Australia) | 10.5 | None | 3.5 mins | 0.95 |
| Ulan (Australia) | 10.5 | Surfonyl 104E | 15-20 secs | 0.95 |
| Peerless Seam | 14.89 | None | 1.5 mins | 0.98 |
| Peerless Seam | 14.89 | Triton X-114* | 15 secs | 0.98 |
| Ohio No. 9 (Freshly Milled) | 24.0 | None | Instantaneous | 1.8 |
| Ohio No. 9 (aged 2 wks) | 24.0 | None | Could not be agglomerated | — |
| Ohio No. 9 | 24.0 | Surfonyl 104E | Instantaneous | 1.8 |

TABLE 12-continued

| Coal | Ash, Raw Coal (Wt %) | Lewis Base Additive (2 lbs/ton of Coal) | Agglomeration Time | Ash, Product Coal (Wt %) |
|---|---|---|---|---|
| (Aged 2 wks) | | | | |

*An octylphenoxypolyethoxy ethanol marketed by Rohm and Haas Co.

High interfacial tension with water was identified above as one of the important characteristics that an agglomerant must possess to be efficacious in the processes disclosed herein. That parameter can be safely relied upon to choose suitable agglomerants; but, at least theoretically, the more fundamental, but related, relationship of importance appears to be the free energy of mixing of the agglomerant with the water in the aqueous, raw coal slurry. The free energy of mixing between two liquids ($\Delta F_m$) can be determined by the Scatchard-Hildebrand free energy of mixing equation (which follows):

$$\Delta F_m=(x_1v_1+x_2v_2)(\delta_1^2+\delta_2^2-2\Phi\delta_1\delta_2)\phi_1\phi_2+RT(x_1 \ln x_1+x_2 \ln x_x)$$

where x=mole fractions of liquids (1) and (2)

v=molar volumes (1,2)

$\Phi$=volume fractions (1,2)

$\delta^2$=energy densities of liquid (1) and (2)

$\phi$=interaction parameter varying from 0.54 for highly immiscible systems to 1.0 for very similar systems; e.g., water-alcohol, etc.

R=gas constant

T=absolute temperature

The first and last terms of the foregoing equation are constant for a given slurry or system as are the interaction parameters and the energy density of water. Consequently, the energy of free mixing in the processes described herein is determined by the energy density of the agglomerant, which therefore becomes the controlling factor in determining the efficacy of an agglomerant in a particular slurry.

A plot of the square root of the energy density ($\delta^2$) of the agglomerant versus the wt % ash in the recovered product coal is a monatomic curve which decreases from a high ash-high energy density value for No. 6 Fuel Oil to a low ash-low energy density value for 1,1,2-trichloro-1,2,2-trifluoroethane.

The free energy mixing equation more accurately identifies the requisite relationship between water and an efficacious agglomerant because there appear to be properties of liquids other than high interfacial tension—such as low mutual solubilities of the agglomerant in water and of the water in the agglomerant—that are also significant. These other properties are all taken into account in the interaction parameter ($\Phi$) in the free energy of mixing equation set forth above. Nevertheless, that interfacial tension remains a valid practical criteria for selecting an agglomerant is apparent because the interaction parameter and the energy densities involved in the Scatchard-Hildebrand free energy of mixing equation have the same origin as those employed in deriving the equations for interfacial energies (see R. J. Good and E. Ebling, "Generalization of Theory for the Estimation of Interfacial Energies", *Chemistry and Physics of Interfaces II,* Amercian Chemical Society, Washington, D.C., 1971, pp. 71–96).

The novel processes disclosed herein have been identified as methods for preparing low ash fuels for the most part. This was done for the sake of convenience and is not intended to limit the scope of the present invention as the low ash coal generated by the present invention can equally well be used for other purposes. For example, it has properties which make it an unparalled feedstock for coal gasification processes (see, for example, U.S. Pat. No. 4,034,572 issued Dec. 8, 1981, to Wiese et al.).

Also, many modifications may be made in the process without exceeding the scope of the invention. For example, mill 20 can be replaced with a two-stage milling system consisting of a ball mill for reducing the raw coal from some top size larger than ¼ inch to at least 100 mesh (150 μm×0) and possibly to 200 mesh (74 μm×0). The product from this mill is sized in a device such as a centrifuge.

The 15 μm×0 overflow from the centrifuge is transferred to mixer 28, and the +15 μm material is cycled through an attritor (stirred ball mill). The output from the attritor is discharged into the centrifuge (in such an arrangement the attritor serves to quite rapidly reduce the 100×15 μm recycled raw coal to 15 μm×0).

As a second example, mixer 28, separator 30, and static sieve bend 34 may be replaced by a cyclone circuit where the 30 to 70 wt % slurry is diluted with more water and agglomerant under vigorous mixing conditions (pumping turbulence) and the agglomerated coal (specific gravity≈1.45) separated from the water-mineral phase in a cyclone. Several tests of this device have demonstrated its efficiency in the preparation of low ash coals. For example, the preparation of 0.5 wt % ash Blue Gem seam coal has been carried out in this manner.

The invention may be embodied in still other specific forms without departing from the spirit or essential characteristics thereof. The embodiments of the invention disclosed above and in the drawing are therefore to be considered in all respects as illustrative and not restrictive. The scope of the invention is instead indicated by the appended claims, and all changes which come within the meaning and range of equivalency of the claims are intended to be embraced therein.

What is claimed is:

1. A process of preparing a low ash coal from a composite of coal and mineral matter, said method comprising the steps of: reducing said composite to a particle size distribution such that said composite can be slurried; mixing said composite with an aqueous liquid in an amount sufficient to form a slurry of said composite; comminuting said composite while in said slurry to a size consist such that the composite is resolved into separate particulate phases of coal and hydrophilic mineral matter and said mineral matter is dispersed in the aqueous carrier of the slurry; thereafter mixing with said slurry a liquid agglomerating agent which: has a high interfacial tension with water and a low viscosity, is capable of being adsorbed onto the surfaces of the coal particles to render them more hydrophobic without effecting the hydrophilicity of the mineral matter, and is selected from the group consisting of:

1,1,2-trichloro-1,2,2-trifluoroethane,
pentane
trichlorofluoromethane, and
2-methylbutane;

agitating the resulting mixture without more than incidental further comminution of the coal, thereby effecting a separation of said coal particles from said aqueous liquid and the mineral matter dispersed therein and a coalesence of said coal particles into product coal agglomerates; and recovering said agglomerates from said slurry.

2. A process for recovering coal from a composite in which mineral matter is associated therewith, said process including the steps of: comminuting said composite in an aqueous liquid until it is resolved into a first phase consisting of particles which are essentially coal and a second phase consisting of particles which are essentially hydrophilic mineral matter; diluting said slurry; adding to the resulting aqueous slurry of coal and mineral matter an agglomerant which: is capable of being adsorbed onto the surfaces of the coal particles to render them more hydrophobic without effecting the hydrophilicity of the mineral matter and of bonding said coal particles into agglomerates of product coal and is selected from the group consisting of:

1,1,2-trichloro-12,2-trifluoroethane,
pentane,
trichlorofluoromethane, and
2-methylbutane;

thereafter subjecting said slurry to agitation without more than incidental further comminution of said coal until the particles of coal have coalesced into agglomerates and the voids between the particles in said agglomerates have been filled with agglomerant to expel water and mineral matter therefrom; and then recovering said agglomerates from the slurry.

3. A process for recovering coal from a composite in which mineral matter is associated therewith, said process including the steps of: comminuting said composite in an aqueous liquid until it is resolved into particles which are essentially coal and particles which are essentially mineral matter; effecting a separation of said coal particles from said mineral matter particles and a coalescence of the coal particles into agglomerates with an agglomerant which: is capable of being adsorbed onto the surfaces of the coal particles to render them more hydrophobic without effecting the hydrophilicity of the mineral matter and of forming liquid bridges between the coal particles and is selected from the group consisting of:

1,1,1-trichloro-1,2,2-trifluoroethane,
pentane,
trichlorofluoromethane, and
2-methylbutane; recovering the agglomerates from the aqueous liquid; introducing the particles making up said agglomerant into an aqueous liquid, reducing the concentration of agglomerant relative to the solids in said liquid to a level sufficient to dissolve said liquid bridges, and agitating the solids and aqueous liquid to thereby effect a dispersion in said aqueous liquid of the coal particles making up said agglomerates and any particles of mineral matter trapped therein to potentiate a separation of the particles of coal and mineral matter; thereafter separating the dispersed coal particles from the dispersed mineral matter particles and effecting a coalesence of the dispersed coal particles with an agglomerant as aforesaid; and recovering the agglomerates thus formed from the aqueous liquid in which the particles were dispersed.

4. A process as defined in any of the preceding claims 1–3 which includes the step of adding to the aqueous liquid in which the composite of coal and mineral matter is comminuted at least one composition which is effective to disperse said composite in said aqueous liquid and thereby promote more efficient comminution of the composite, said composition being a liquid fluorocarbon, an ionic surfactant, or a nonionic surfactant.

5. A process as defined in any of the preceding claims 1–3 wherein said composite is comminuted in said slurry predominantly to a top size of not more than about 30 microns.

6. A process as defined in any of the preceding claims 1–3 wherein said composite is comminuted before said slurry is formed predominantly to a top size of not more than about 250 microns by dry milling.

7. A process as defined in any of the preceding claims 1–3 wherein said slurry is maintained at a pH in the range of 6 to 10 during the comminution of the composite therein.

8. A process as defined in any of the preceding claims 1–3 wherein the ratio of composite to water in the slurry during the comminution of the coal in the slurry is not less than 20 to 70 weight percent.

9. A process as defined in any of the preceding claims 1–3 wherein the mixing of said agglomerant with said slurry is carried out in a separate processing unit from the subsequent dissociation of the coal particles from the aqueous and mineral matter phases of said slurry and agglomeration of the coal particles.

10. A process as defined in any of the preceding claims 1–3 wherein the separation of the coal particles from the slurry and the coalesence of those particles into agglomerates is carried out at a temperature in the range of 21.1°±6° C.

11. A process as defined in any of the preceding claims 1–3 wherein the raw coal is sub-bituminous and wherein a surfactant is mixed with said slurry prior to separation and agglomeration of the coal particles in an amount effective to generate on said coal particles apparent surfaces which are compatible with the agglomerant employed to effect said separation and agglomeration.

12. A low ash coal produced by a process as defined in any of the preceding claims 1–3.

13. A process for recovering coal as defined in claim 3 wherein the dispersion of the coal particles making up the agglomerates is effected by removing sufficient agglomerant from the mixture of agglomerates and aqueous liquid to reduce the concentration of agglomerant to 20–30 percent based upon the weight of the solids in the mixture.

14. A process as defined in claim 13 wherein the removal of the agglomerant is promoted by heating the mixture of agglomerates and aqueous liquid.

15. A process for recovering a partially oxidized or lower rank coal from a composite in which mineral matter is associated therewith, said process including the steps of: comminuting said composite in an aqueous liquid slurry until it is resolved into particles which are essentially coal and particles which are essentially mineral matter; effecting a separation of said coal particles from said mineral matter particles and a coalesence of the coal particles into agglomerates with an agglomerant which is capable of being adsorbed onto the surfaces of the coal particles to render them more hydrophobic without effecting the hydrophilicity of the mineral matter and of forming liquid bridges between the coal particles and which is selected from the group consisting of:

1,1,1-trichloro-1,2,2-trifluoroethane,
pentane,
trichlorofluoromethane, and
2-methylbutane;

and recovering the agglomerates from the aqueous liquid, said process being characterized by the step of dispersing in said slurry an additive which is capable of increasing the adsorptivity of the surfaces of the coal particles with respect to said agglomerant.

16. A process as defined in claim 15 wherein the adsorptivity increasing additive is selected from that group of compounds having the formulas ROH, $RNH_2$, $R_2NH$, and $R_3N$ where R is an organic ring or an organic chain having more than four carbon atoms.

17. A process as defined in claim 15 wherein the adsorptivity increasing additive is a surfactant.

18. A process as defined in claim 7 which includes the step of adding to the aqueous liquid in which the composite of coal and mineral matter is comminuted at least one composition which is effective to increase the pH of the slurry of aqueous medium and composite.

19. A process as defined in claim 15 wherein the adsorptivity increasing additive is a Lewis base.

20. A process as defined in claim 1 wherein said liquid agglomerating agent is mixed with said slurry in an amount which is sufficient to essentially completely fill the voids between the particles making up the product coal agglomerates.

21. A process as defined in claim 20 wherein said liquid agglomerating agent is mixed with the diluted slurry in an amount ranging from 45 to 60 percent based on the dry weight of the coal in said slurry.

22. A process as defined in claim 1 wherein said liquid agglomerating agent is mixed with said slurry in an amount which is sufficient to form a stable, encapsulating monolayer film around each of the coal particles present in said slurry.

23. A process as defined in claim 2 wherein said slurry is diluted after the comminution of the composite in the liquid phase to a solids content of 1 to 14 weight percent.

24. A process as defined in claim 3 wherein, in the step of introducing the particles making up the first mentioned agglomerates into an aqueous liquid, the concentration of solids in the aqueous liquid is adjusted to a concentration in the range of 30 to 10 weight percent.

25. A process as defined in claim 3 wherein, in the step of reducing the concentration of agglomerant to a level sufficient to make a dispersion of the particles making up the agglomerates possible, said concentration is reduced to a level of 20 to 30 percent based on the weight of the solids in the slurry.

26. A process as defined in claim 15 wherein said adsorption increasing additive is mixed with said slurry in an amount that is sufficient to form a monolayer of the additive on the particles of coal in the slurry.

* * * * *

UNITED STATES PATENT AND TRADEMARK OFFICE

CERTIFICATE OF CORRECTION

PATENT NO. : 4,484,928

DATED : November 27, 1984

INVENTOR(S) : Douglas V. Keller, Jr.

It is certified that error appears in the above-identified patent and that said Letters Patent is hereby corrected as shown below:

Title page:

Change "Otisca Industries, Inc." to --Otisca Industries,Ltd.--

Signed and Sealed this

*Twenty-second* Day of *October 1985*

[SEAL]

*Attest:*

DONALD J. QUIGG

*Attesting Officer*

*Commissioner of Patents and Trademarks—Designate*